US006012572A

United States Patent [19]

Heathcock et al.

[11] Patent Number: 6,012,572

[45] Date of Patent: Jan. 11, 2000

[54] PORTABLE, FLEXIBLE FACIAL TISSUE DISPENSING SYSTEM FOR DISPENSING TISSUES

[75] Inventors: John A. Heathcock, Racine; Patricia L. Samolinski, Menasha; Christopher R. McKinney, Appleton; John L. Herzberg, Butte Des Morts, all of Wis.; Michael C. Tuck, LaGrange, Ga.

[73] Assignee: Kimberly-Clark Worldwide, Inc., Neenah, Wis.

[21] Appl. No.: 09/222,120

[22] Filed: Dec. 29, 1998

Related U.S. Application Data

[60] Provisional application No. 60/070,075, Dec. 31, 1997.

[51] Int. Cl.[7] ..... B65D 73/00

[52] U.S. Cl. ..... 206/233; 206/494; 206/812

[58] Field of Search ..... 206/205, 207, 206/210, 233, 38, 494, 499, 812; 53/462

[56] References Cited

U.S. PATENT DOCUMENTS

| | | |
|---|---|---|
| D. 295,832 | 5/1988 | Shelton . |
| 1,028,084 | 5/1912 | Bond . |
| 1,518,628 | 12/1924 | Wood . |
| 1,706,166 | 3/1929 | Hunt . |
| 1,747,601 | 2/1930 | Reps et al. . |
| 1,982,616 | 11/1934 | Medoff . |
| 2,033,621 | 3/1936 | Freedman . |
| 2,093,724 | 9/1937 | Horwitt . |
| 2,118,472 | 5/1938 | Morris . |
| 2,125,618 | 8/1938 | Nystrand . |
| 2,138,425 | 11/1938 | Morris . |
| 2,195,622 | 4/1940 | Fourness et al. . |
| 2,348,041 | 5/1944 | Warner . |
| 2,473,932 | 6/1949 | Wolf . |
| 2,529,853 | 11/1950 | Taggart . |
| 2,559,528 | 7/1951 | Barrett . |
| 2,574,345 | 11/1951 | Montgomery . |
| 2,611,482 | 9/1952 | Nelson . |
| 2,621,788 | 12/1952 | Hitchcock . |
| 2,656,916 | 10/1953 | Henderson . |
| 2,761,584 | 9/1956 | Johnson et al. . |
| 2,768,739 | 10/1956 | Gongolas . |

FOREIGN PATENT DOCUMENTS

| | | |
|---|---|---|
| 282833 | 11/1968 | Australia . |
| 470433 | 1/1951 | Canada . |
| 1151121 | 8/1983 | Canada . |
| 2003256 | 5/1990 | Canada . |
| 1321175 | 8/1993 | Canada . |
| 2334584 | 12/1982 | France . |
| 3100286 A1 | 1/1982 | Germany . |
| 3324490 C1 | 11/1984 | Germany . |
| 3437351 A1 | 4/1985 | Germany . |
| 3542999 A1 | 8/1986 | Germany . |
| 3514943 A1 | 10/1986 | Germany . |
| 0505675 A1 | 9/1992 | Germany . |
| 0119314 | 9/1984 | Japan . |
| 0179624 | 4/1986 | United Kingdom . |
| 2177376 | 1/1987 | United Kingdom . |
| WO 91/04920 | 4/1991 | WIPO . |

*Primary Examiner*—Jacob K. Ackun
*Attorney, Agent, or Firm*—Brinks Hofer Gilson & Lione

[57] ABSTRACT

This invention is directed to a facial tissue dispensing system which is a portable, flexible pack for dispensing large tissues. The portable, flexible pack container is thin yet contains regular-sized or large-sized tissues for cleaning in the alternative to paper towels or rags. Before being placed into the container, each of the tissues is first reversibly folded three times onto itself to decrease the size of the tissue in first or lateral dimension and is second reversibly folded onto itself at least one time to decrease the size of the tissue in a second or longitudinal dimension, which is generally perpendicular to the first dimension. The tissues are folded such that they unfold as they pass through the tissue dispensing opening of the container. The tissue dispensing opening may be covered by a resealable closure flap. In this manner, tissues are kept from the environment to keep them clean and dry. This invention is also directed to a container for containing and dispensing the portable, flexible packs.

25 Claims, 5 Drawing Sheets

U.S. PATENT DOCUMENTS 3,007,605 11/1961 Donovan .
3,012,692 12/1961 Petersen .
3,119,516 1/1964 Donovan .
3,198,228 8/1965 Naito .
3,369,700 2/1968 Nelson .
3,403,815 10/1968 Robson .
3,581,935 6/1971 Chi .
3,700,138 10/1972 Nelson .
3,747,802 7/1973 Uroshevich .
3,881,632 5/1975 Early et al. .
4,002,264 1/1977 Marchesani .
4,131,195 12/1978 Worrell, Sr. .
4,156,493 5/1979 Julius .
4,185,754 1/1980 Julius .
4,192,420 3/1980 Worrell, Sr. et al. .
4,231,491 11/1980 Pierson et al. .
4,252,238 2/1981 Spiegelberg et al. .
4,420,080 12/1983 Nakamura .
4,428,477 1/1984 Cristofolo .
4,460,088 7/1984 Rugenstein et al. .
4,540,091 9/1985 Haböck .
4,550,855 11/1985 Harrison .
4,552,269 11/1985 Chang .
4,570,820 2/1986 Murphy .
4,610,357 9/1986 Nakamura .
4,651,874 3/1987 Nakamura .
4,700,841 10/1987 Padgett, Jr. et al. .
4,709,399 11/1987 Sanders .
4,739,879 4/1988 Nakamura .
4,790,436 12/1988 Nakamura .
4,863,064 9/1989 Dailey, III .
4,877,154 10/1989 Matsui .
5,036,978 8/1991 Frank et al. .
5,040,685 8/1991 Focke et al. .
5,048,687 9/1991 Suzuki et al. .
5,048,718 9/1991 Nakamura .
5,065,868 11/1991 Cornelissen et al. .
5,076,424 12/1991 Nakamura .
5,076,465 12/1991 Lawson .
5,145,091 9/1992 Meyers .
5,152,121 10/1992 Nakamura .
5,161,350 11/1992 Nakamura .
5,165,545 11/1992 Focke et al. .
5,184,725 2/1993 Reinheimer et al. .
5,295,579 3/1994 Focke et al. .
5,328,053 7/1994 Cook et al. .
5,333,735 8/1994 Focke et al. .
5,356,032 10/1994 Rhodes .
5,361,936 11/1994 Cook .
5,363,986 11/1994 Cook .
5,377,837 1/1995 Roussel .
5,379,897 1/1995 Muckenfuhs et al. .
5,427,245 6/1995 Roussel .
5,524,759 6/1996 Herzberg et al. ..... 206/233 X
5,678,728 10/1997 Leto ..... 206/233 X

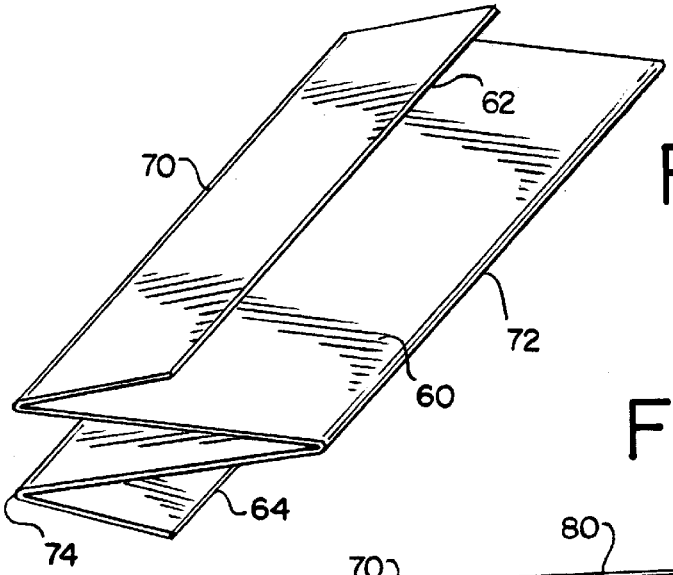
FIG. 8
FIG. 9
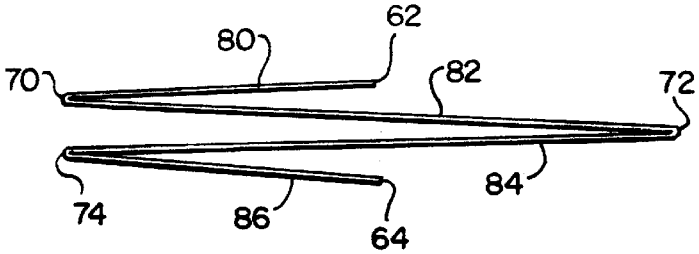
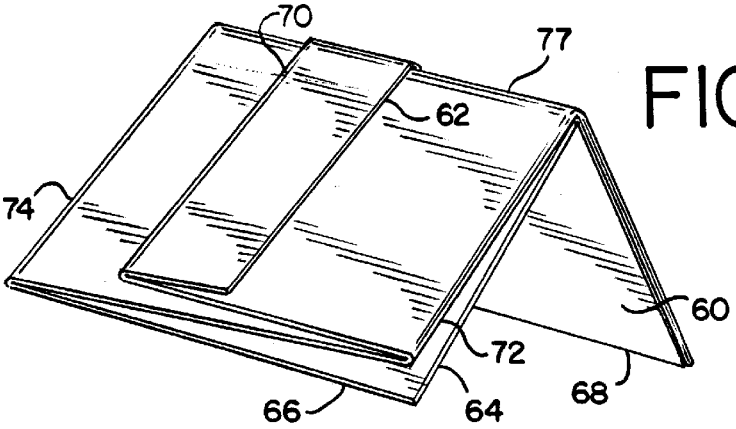
FIG. 10
FIG. 11
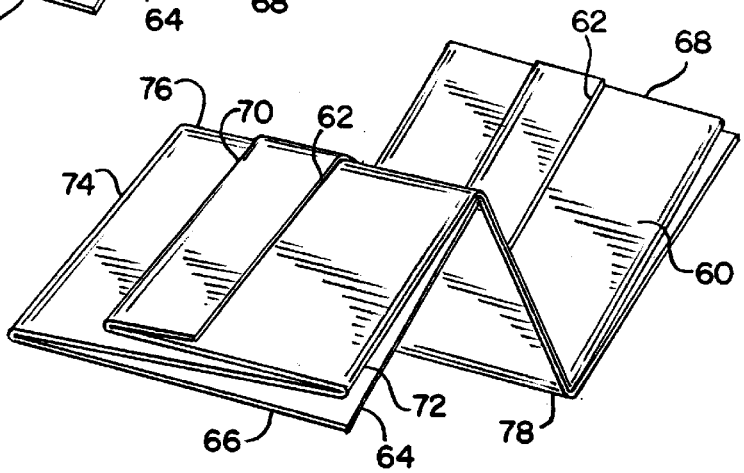

FIG. 12
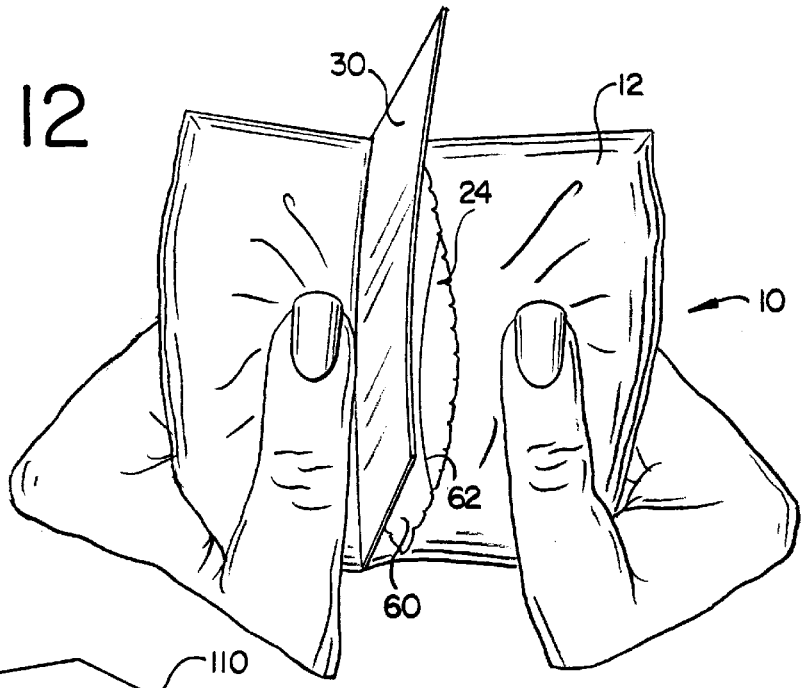
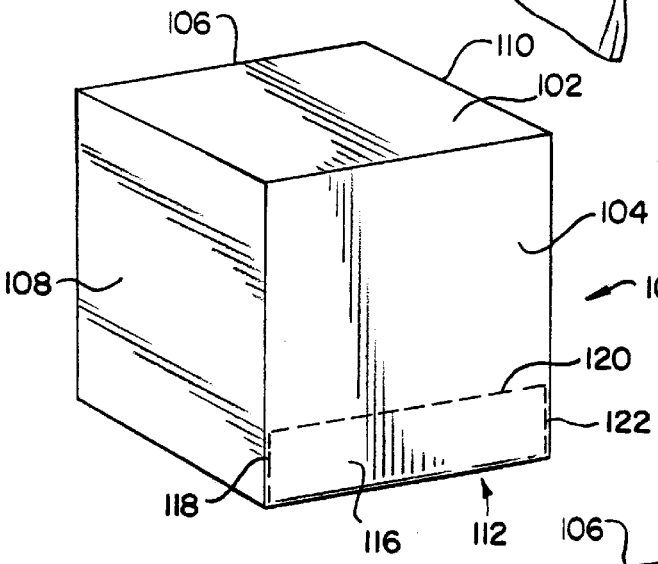
FIG. 13
FIG. 14
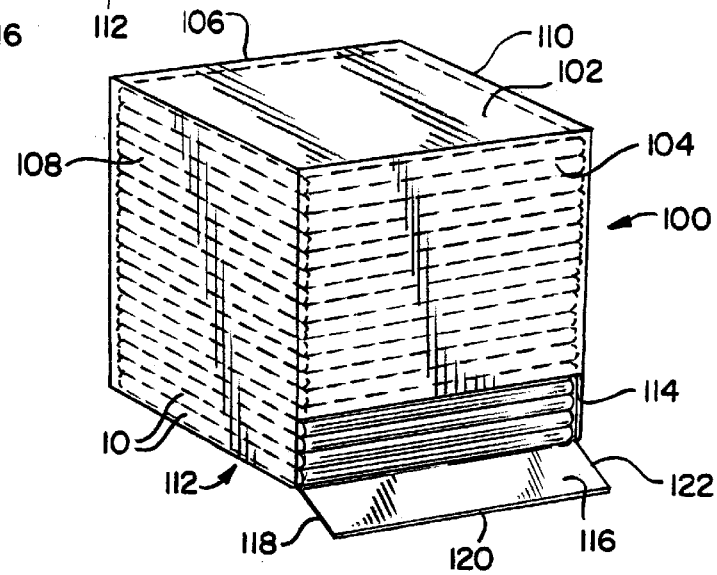

PORTABLE, FLEXIBLE FACIAL TISSUE DISPENSING SYSTEM FOR DISPENSING TISSUES

RELATED APPLICATION

This application claims priority to U.S. Provisional Application Ser. No. 60/070,075, filed on Dec. 31, 1997, entitled "Portable, Flexible Facial Tissue Dispensing System for Dispensing Tissues," the entire disclosure of which is incorporated herein by reference.

FIELD OF THE INVENTION

This invention relates to a facial tissue dispensing system, and more particularly, to a facial tissue dispensing system which is portable and made of a soft material, such as a plastic film, for dispensing regular-sized or large-sized tissues, including moist or dry tissues.

BACKGROUND OF THE INVENTION

Facial tissues are well known in the art. The uses of facial tissues include, but are not limited to, blowing one's nose, cleaning one's glasses and other personal and household cleaning uses. Generally, a facial tissue dispensing system includes a stack of facial tissues placed within a container, usually a cardboard carton, or a plastic film package, commonly known as a pocket or portable pack.

The cartons are generally large in size. For example, a rectangular carton may be about 9⅜ inches in length by about 4¾ inches in height by 4¾ inches in width. These cartons are generally positioned by the user in a particular place in his or her home or office and left at that location. Thus, when the user desires a tissue, he or she must travel to the carton where it is located to dispense a tissue from the carton for his or her use.

On the other hand, portable packs are generally small in size. One example is generally about ⅞ inch in height by about 2¼ inches in width by about 4¼ inches in length. The portable packs are designed to travel with the user in his or her pocket, bag, purse or the like. Thus, when a user wants a tissue from a portable pack, he or she must merely reach into his or her pocket or purse to grab a tissue from the portable pack.

Various problems exist, however, with current portable packs. One problem is that the portable pack may not be durable enough to withstand days or weeks in one's pocket or purse, the time usually required to use all of the tissues in a portable pack. A second problem may be that the closure device of the portable pack, which generally is a resealable opening, may not be durable enough to withstand repeated openings and closings, especially if the closure device is located at the same location as where the tissues are dispensed, i.e., the tissue dispensing opening. If the closure device is located at the tissue dispensing opening, the repeated and frequent act of pulling or drawing tissues over the resealable opening distorts and stretches the closure device, thereby rendering the device useless at keeping the portable pack closed. Therefore, if the portable pack is not durable enough, tissues could become dirty and/or fall out of the pack. Tissues may also become dirty as they are pulled out of the portable pack if the closure device accumulates dirt and lint on its adhesive portion.

Another problem with current portable packs is that it may not be quick and easy to access a tissue due to the folding of tissues placed in the pack. Because of the small size of portable packs, tissues must be folded multiple times in order to contain several tissues in the small space. However, because of the multiple folds, the user generally must unfold the tissue after dispensing it from the portable pack before being able to use the full-size tissue. This makes it difficult for the user to be able to use the full-size tissue quickly after dispensing it from the portable pack. Moreover, if the tissue needs to be used quickly, before the user has a chance to unfold it, the tissue may not be large enough to offer adequate protection. Another problem which results from the multiple folds is that the user may believe that the tissue is smaller than it actually is.

While portable packs are small in size, many of them are too bulky to be carried comfortably and discreetly in a user's pocket. For example, where the portable pack is about ⅞ inch in height, it is generally too bulky to be placed into one's pants pocket comfortably.

Because of the ability of the portable packs to travel, the range of uses of the facial tissues in a portable pack is greater than those kept in a carton in one location in a home or office. For a spill in one's home, a person can use a variety of materials to clean the spill, such as a facial tissue, a paper towel, a rag or the like. During travel, however, people generally do not have paper towels or rags contained in their purses or cars. Thus, facial tissues in the portable packs are used to clean a variety of spills and the like when paper towels and rags are not available. Current facial tissues in portable packs, however, may not be large enough to be effective in cleaning spills and the like when paper towels or rags are not available.

Accordingly, it would be desirable to provide a portable, flexible pack tissue dispensing system which is durable enough to be stored in one's pocket or purse for long periods of time and which is durable enough to withstand repeated openings and closings. Moreover, it would be desirable to provide a portable, flexible pack tissue dispensing system which contains large tissue sheets yet which is still small and discreet enough to be placed comfortably and easily into one's pocket or purse. In addition, it would be desirable to provide a portable, flexible pack tissue dispensing system where the tissues contained therein are large enough to be suitable for a wide variety of tasks, such as nose-blowing, as well as cleaning up spills, in the alternative to a paper towel or rag. Last, it would be desirable to have a supply of these portable packs close to the exit of your home so that you remember to place a pack in your pocket, purse, a child's backpack or the like before leaving your house.

SUMMARY OF THE INVENTION

One aspect of the invention provides a portable, flexible facial tissue dispensing system for dispensing regular-sized or large-sized tissues comprising a generally square or rectangular, flat, flexible container and a stack of individually multiple folded tissues contained within the container. The container includes a top wall and a bottom wall. The top wall includes an opening formed therein through which tissues are dispensed. Each tissue has a first dimension and a second dimension, which is generally perpendicular to the first dimension. Before being placed into the container, the tissues are multiple folded. In particular, each tissue is first reversibly folded onto itself three times to decrease its size in the first dimension and then reversibly folded onto itself at least one time to decrease its size in the second dimension. The tissues are folded such that an edge of the uppermost tissue of the stack is provided at the tissue dispensing opening included in the top wall of the container. Moreover, the tissues are folded such that the uppermost tissue unfolds from its multiple folded position as the edge of this tissue is grasped and pulled through the tissue dispensing opening and is thus immediately available for use by the user.

The tissues in the stack preferably have an area of about 72 to about 144 square inches, or, more preferably, about 100 to about 144 square inches. The flexible container preferably contains no less than the three individual tissues and no more than 20 individual tissues. Preferably, the flexible container contains between five and ten tissues. The flexible container may preferably be comprised of a plastic film material or a nonwoven material. The tissue dispensing opening may be a slit, a window, or a window with a plastic film covering the window where the film has a tissue dispensing slit formed therein. The container may preferably include a resealable closure device which overlays the tissue dispensing opening or slit. The resealable closure device is preferably a flap which is joined to the top wall of the container at a location remote from the tissue dispensing opening or slit.

Another aspect of the invention provides a method of operating a portable, flexible facial tissue dispensing system. A generally square or rectangular, flat flexible container and a stack of multiple folded tissues contained within the container are provided. The flexible container includes a top wall and a bottom wall. The top wall includes an opening formed therein through which tissues are dispensed. Each tissue has a first dimension and a second dimension, which is generally perpendicular to the first dimension. Before being placed into the container, the tissues are multiply folded. In particular, each tissue is first reversibly folded onto itself three times to decrease its size in the first dimension and then reversibly folded onto itself at least one time to decrease its size in the second dimension. The tissues are folded such that an edge of the uppermost tissue of the stack is provided at the tissue dispensing opening. The edge of the uppermost tissue is pulled through the tissue dispensing opening such that the tissue unfolds as it is grasped and pulled through the opening.

Another aspect of the invention provides a generally rectangular container which contains at least one, and preferably a plurality, of the portable, flexible pack containers. This container includes a top wall, a bottom wall, side walls and end walls. The container includes an opening in one wall through which the portable pack containers may be dispensed. The opening is preferably a flap defined by perforated edges. The perforated edges are broken to open the flap to dispense the portable pack containers through the opening. The container may be freestanding or may include a device so that it can be stuck or hung on a wall or cabinet.

These and other objects, advantages, and features of the present invention will be better understood upon review of the following detailed description of the preferred embodiments.

BRIEF DESCRIPTION OF THE DRAWINGS

FIG. 8 is a perspective view of the tissue shown in FIG. 7;

FIG. 9 is a side view of the tissue shown in FIG. 7;

FIG. 10 is a perspective view illustrating an embodiment of folding a tissue once to decrease the size of the tissue in the second dimension;

FIG. 11 is a perspective view illustrating an embodiment of folding a tissue twice to decrease the size of the tissue in the second dimension;

FIG. 12 is a perspective view of the opening of the facial tissue dispensing system of the present invention to dispense tissues; and FIGS. 13 and 14 are perspective views of the container for containing a plurality of portable, flexible pack containers of the present invention.

DETAILED DESCRIPTION OF THE PREFERRED EMBODIMENTS

Figure 1:
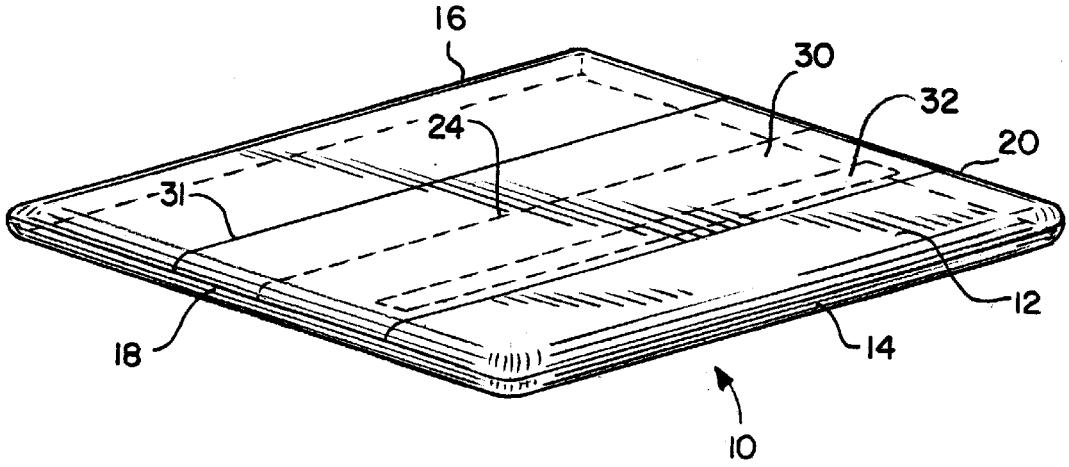
FIG. 1 is a perspective view of the present invention.
Figure 2:
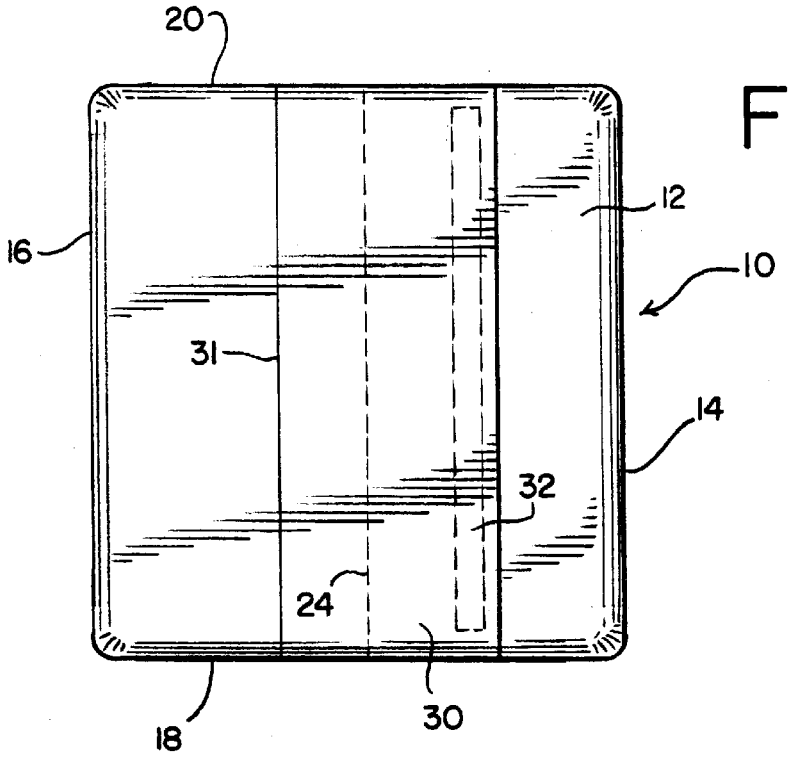
FIG. 2 is a plan view of the present invention shown in FIG. 1.
Figure 3:
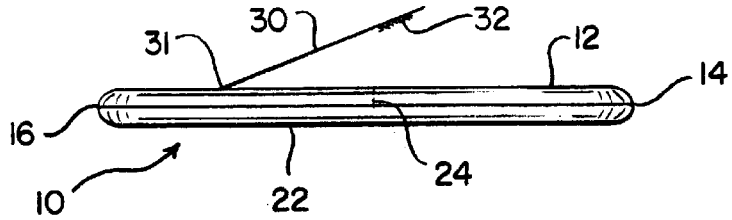
FIG. 3 is a side view of the present invention shown in FIG. 1.

FIGS. 1, 2 and 3 illustrate the portable, flexible tissue dispensing system for dispensing regular-sized or large-sized tissues of the present invention. Generally, the portable, flexible facial tissue dispensing system includes a thin, square or rectangular package or container 10. The container 10 has a top wall 12, two side walls 14, 16, two end walls 18, 20 and a bottom wall 22. While the thin container 10 may be made in a variety of sizes, it is preferably about ⅛ to ¾ inch in height, about 4¼ inches to 4⅝ inches in width and in length.

The portable, flexible pack container 10 contains an opening 24 on the top wall 12 wherein tissues are dispensed through the opening. The tissue dispensing opening 24 may preferably be, as in shown in the accompanying figures, a perforated slit. However, the tissue dispensing opening 24 is not limited to a perforated slit, but may be made of any size, such as, for example, a rectangular opening or a non-rectangular shaped opening, including, but not limited to, an oval or round shape. The tissue dispensing opening 24 may be covered by a piece of plastic film (not shown). If so, an opening is provided in the film through which tissues are dispensed. The size and position of the opening 24 is dependent upon the size of the tissues. The opening 24 is designed to facilitate ease in tissue removal and to keep the tissues clean until they are dispensed from the portable, flexible pack container 10.

As shown in FIGS. 1, 2 and 3, the portable, flexible pack container 10 may also include a resealable closure device for the tissue dispensing opening 24. The closure device may preferably be a tissue closure flap 30 which is larger than and overlays or covers the tissue dispensing opening 24. The closure flap 30 is attached to the top wall 12 of the portable pack container 10 at one edge of the flap 30, such as edge 31. The closure flap 30 may generally utilize a variety of closure mechanisms, including, but not limited to, using adhesives, cohesives and hook and loop closures. Thus, in the embodiment shown in FIGS. 1, 2 and 3, adhesive 32 is placed on the closure flap 30 to adhere the closure flap 30 to the top wall 12 of the portable pack container 10. Generally, because the closure flap 30 is larger than the tissue dispensing opening 24, the closure flap 30 is adhered to the top wall 12 remote from the tissue dispensing opening 24. In this manner, tissues which are dispensed from the portable pack container 10 do not effect the closure device of the present invention.

The portable pack container 10 generally contains no less than three and no more than 20 individual sheets of tissue. Preferably, the container 10 contains between five and ten tissues. The tissues are generally sized from about 72 square inches to about 144 square inches in area. Preferably, the tissues are about 100 square inches to about 144 square inches in area. The tissues can be made in a variety of manners which are well known in the art. The tissues may be one ply, or may be two or more plies. Moreover, the tissues may be dry or wet.

Before being placed into the portable pack container 10, the tissues are individually folded multiple times such that an edge of the uppermost tissue of the stack of tissues is provided and visible at the tissue dispensing opening 24 to provide a "handle" to pull the tissue from the portable pack container 10. In addition, the tissues are multiply folded such that each tissue unfolds as it is being removed from the portable pack container 10 and is thus immediately available for use by the user. Folding of the tissues before they are placed into the portable pack container 10 is known as "pre-folding."

Figure 5:
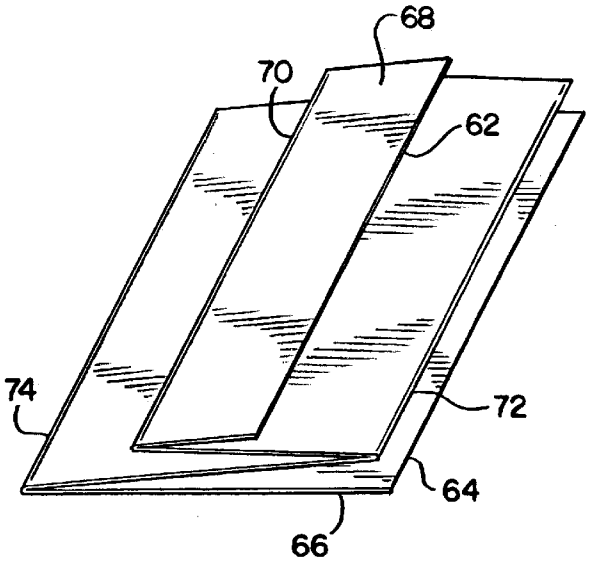
FIG. 5 is a perspective view of the tissue shown in FIG. 4.
Figure 4:
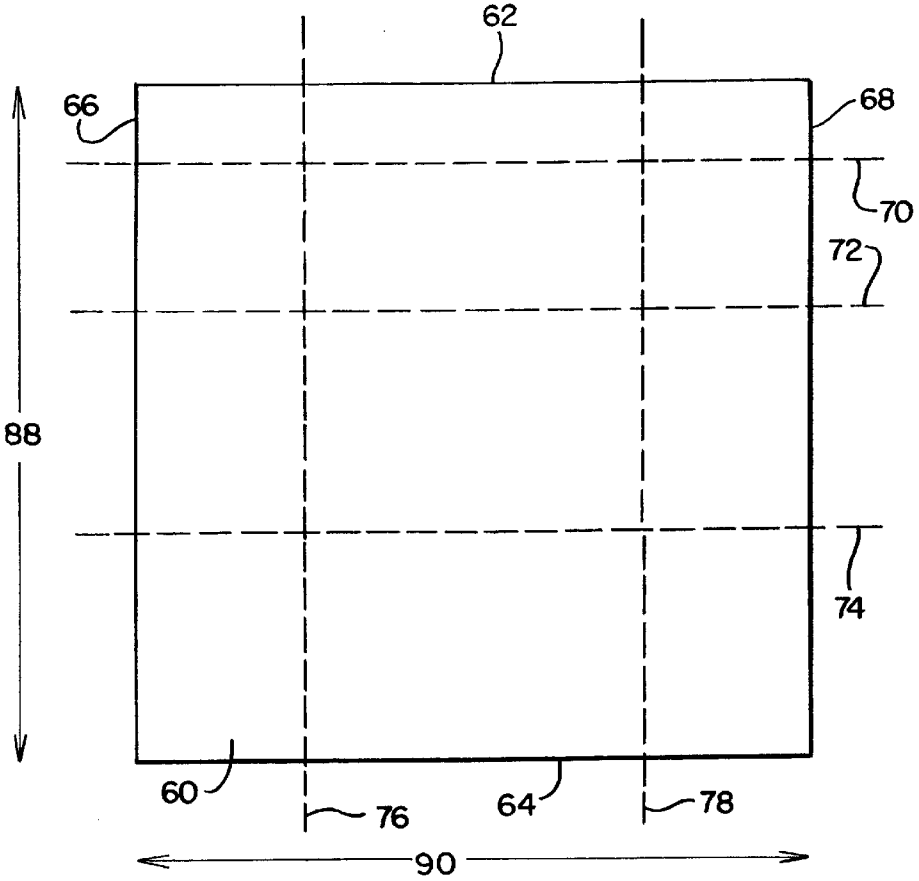
FIG. 4 is a plan view of one embodiment of a folded tissue of the present invention illustrating the fold lines of the tissue of this embodiment.
Figure 7:
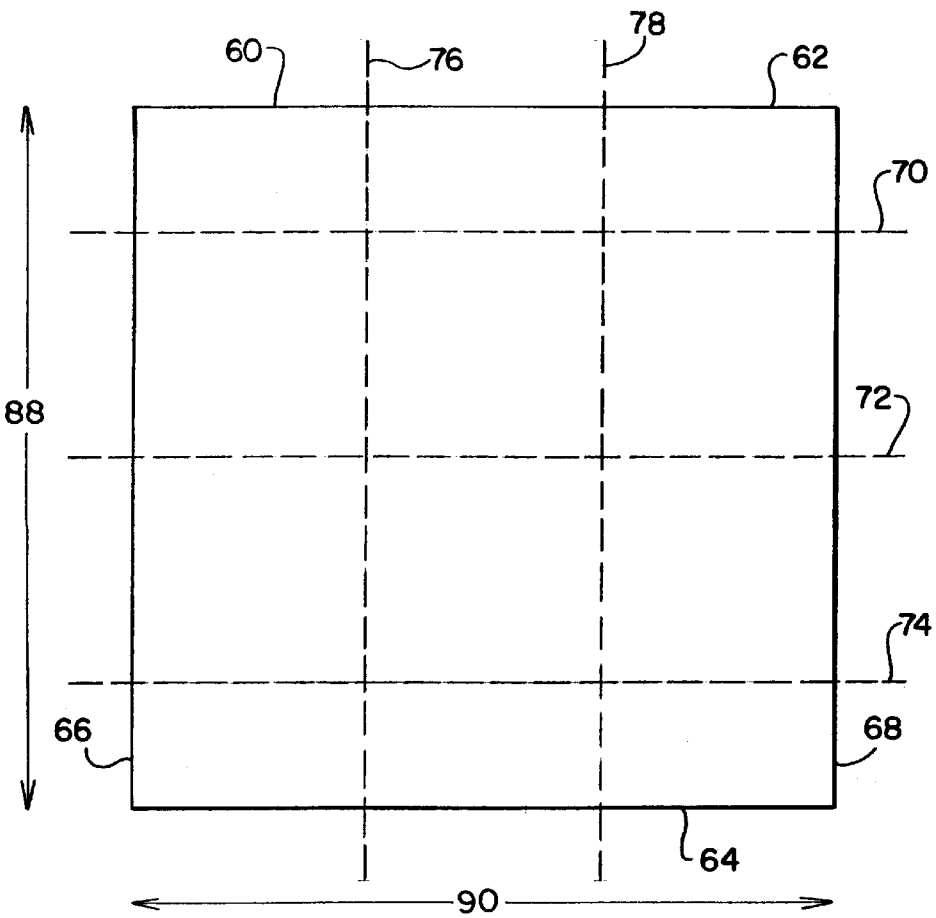
FIG. 7 is a plan view of a second embodiment of a folded tissue of the present invention illustrating the fold lines of the tissue of this embodiment.
Figure 6:
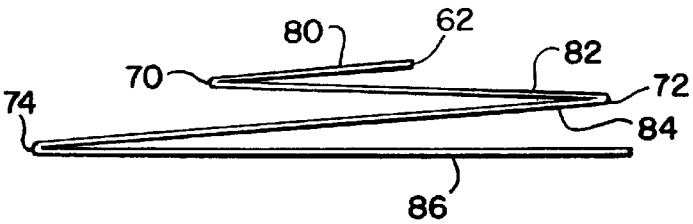
FIG. 6 is a side view of the tissue shown in FIG. 4.

Pre-folding of the tissues 60 is illustrated for one embodiment in FIGS. 4 through 6 and for a second embodiment in FIGS. 7 through 9. As shown in FIGS. 4 and 7, each tissue 60 has two edges 62, 64 which are opposite each other and two edges 66, 68 which are also opposite each other. For sake of convenience, we designate edges 62, 64 as the side or lateral edges 62, 64, and edges 66, 68 as the end or longitudinal edges 66, 68. Additionally, each tissue 60 has a first dimension 88 and a second dimension 90, which is generally perpendicular to the first dimension. For convenience, we designate the first dimension 88 as the lateral dimension, which is the distance between lateral edges 62, 64. Similarly, we designate the second dimension 90 as the longitudinal dimension, and thus the distance between longitudinal edges 66, 68. The terms "lateral," "longitudinal," "side" and "end" are not limiting and are interchangeable. Generally, though, edge 62 is the edge of the tissue 60 that, after the tissues are placed into the container 10, is provided and visible at the tissue dispensing opening 24.

As shown in FIGS. 4 through 6, and FIGS. 7 through 9, for the folding of tissues 60 for the present invention, each tissue 60 has at least three fold lines 70, 72, 74 which are parallel to the lateral edges 62, 64. Each tissue 60 is reversibly folded onto itself three times along the fold lines 70, 72, 74 to decrease the size of the tissue 60 in its first dimension 88. In addition, the tissue has at least one fold line which is parallel to the longitudinal edges 66, 68. Thus, each tissue 60 is also reversibly folded onto itself along the fold line(s) to decrease the size of the tissue 60 in its second dimension 90. In FIGS. 4 and 7, and as shown in FIG. 11, the tissue 60 is folded two times in the second or longitudinal dimension 90 about fold lines 76, 78. The tissue 60, however, is not limited to being folded one time (FIG. 10) or two times (FIG. 11), but may be folded any number of times, in the longitudinal dimension 90.

By comparing FIGS. 4 and 7, it is shown that the placement of the fold lines 70, 72, 74 may vary in location between the two lateral edges 62, 64. Further, as shown in FIGS. 6 and 9, after a tissue 60 is reversibly folded onto itself three times to decrease the size of the tissue 60 in the first or lateral dimension, there are four layers of a tissue 60: the first layer 80, the second layer 82, the third layer 84 and the fourth layer 86. Thus, at this point, the tissue 60 is narrower in the lateral dimension to fit inside the portable pack container 10. In particular, after being reversibly folded three times, the lateral dimension of the tissue is equal to the length of the longest layer 80, 82, 84 or 86. In other words, the lateral dimension of the folded tissue 60 is the same as the longest distance between one of the following: (1) lateral edge 62 and fold line 70, (2) fold line 70 and fold line 72, (3) fold line 72 and fold line 74 or (4) fold line 74 and lateral edge 64. Because the placement of the fold lines 70, 72, 74 may vary, the length of the lateral dimension of the tissue 60 may vary. Thus, in the embodiment shown FIGS. 4 through 6, the length of the lateral dimension of the tissue 60 is about the same as the third and fourth layers 84, 86, which are approximately the same length. Similarly, in the embodiment shown in FIGS. 7 through 9, after being folded, the tissue 60 has a length in the lateral dimension which is the same as the lengths of the second and third layers 82, 84, respectively, which are about the same.

As stated above, after the tissue 60 is folded to decrease its size in the lateral dimension, it must also be folded at least once to decrease its size in the longitudinal dimension to fit into the portable pack container 10. In FIG. 10, the tissue 60 is shown folded one time to decrease its size in the longitudinal dimension with one longitudinal fold line 77. In this embodiment, the fold line 77 is generally located one-half of the distance between longitudinal edges 66, 68. Thus, at this point, the tissue 60 is folded about in half to have about one half of its unfolded size. The tissue 60 may then fit inside the portable pack container 10.

Similarly, in FIG. 11, the tissue 60 is shown folded two times to decrease its size in the longitudinal dimension with two longitudinal fold lines 76, 78. Basically, the tissue is reversibly folded twice onto itself to decrease its size in the longitudinal dimension about fold lines 76, 78 to fit inside the portable pack container 10. For this embodiment, the tissue 60 is generally folded in thirds in the longitudinal dimension. In other words, fold line 76 is generally located about one-third of the tissue length (in the longitudinal dimension) from longitudinal edge 66 and about two-thirds of the tissue length from longitudinal edge 68. Similarly, fold line 78 is generally located about two-thirds of the tissue length from longitudinal edge 66 and about one-third of the tissue length from longitudinal edge 68. Thus, after longitudinal folding of the tissue 60, the longitudinal dimension of the multiple folded tissue 60 is approximately one-third of its unfolded size.

In either of the embodiments shown in FIGS. 4 through 6 or FIGS. 7 through 9, the tissues 60 are individually folded multiple times such that the edge 62 of the tissue 60 is provided and visible at the tissue dispensing opening 24 to provide a handle to pull the tissue 60 from the portable pack container 10. Thus, as shown in FIG. 12, when the user grabs the edge 62 of the tissue 60 and pulls the tissue 60 from the portable pack container 10, the tissue 60 unfolds, i.e., the tissue straightens out, as it is being dispensed from the portable pack container 10 through the tissue dispensing opening 24. In other words, as the lateral fold lines 70, 72, 74 and the longitudinal fold lines 76, 78 of the tissue 60 pass through the tissue dispensing opening 24, each of the fold lines 70, 72, 74, 76, 78 flatten out to form a flat tissue 60. Therefore, immediately after the user dispenses the tissue 60 fully from the portable pack container 10, the tissue is unfolded and is immediately available for use by the user.

The portable pack container 10 may be made of a variety of flexible, plastic film materials, such as polyethylene, polypropylene or polyester. The portable pack container 10 may also be made of any flexible, nonwoven material. The flexible material must be durable enough to withstand being stored in a pocket or purse for long periods of time. The flexible material must also be able to form a barrier between the tissues and the environment to keep the tissues clean and dry, while also being easy to process and cost-effective. The flexible material may possess properties which enhances its ability to provide protection from moisture or other elements in the environment. The flexible material may also be treated to retain moisture or scents in the tissues which are contained within the portable pack.

As shown in FIGS. 13 and 14, the present invention is also directed to a single, generally rectangular container 100 for containing a plurality of portable pack containers 10 for easy storage and transport. The container 100 has a top wall 102, side walls 104, 106, end walls 108, 110 and a bottom wall 112. The container 100 includes an opening 114 which is formed on one of the walls. Preferably, the opening 114 is located on a side wall, such as side wall 104. The opening 114 is large enough such that at least one portable pack container 10 may be dispensed through the opening 114.

The opening 114 is preferably a flap 116 with perforated edges 118, 120, 122. Thus, before the perforated edges 118, 120, 122 are broken to free the flap 116, the container 100 is closed to contain a plurality of portable pack containers 10 for easy transport and storage. Once the user decides to dispense a portable pack container 10 from the container 100, he or she breaks the perforated edges 118, 120, 122 to free the flap 116. The flap 116 is then pulled away from wall 104. As shown in FIG. 14, if the flap 116 is positioned at the bottom of side wall 104, then the flap 116 is flap 116. The flap 116 is then pulled away from wall 104. As shown in FIG. 14, if the flap 116 is positioned at the bottom of side wall 104, then the flap 116 is preferably pulled downward from the side wall 104 to rest generally parallel to the bottom wall of the container 100.

After the flap 116 is pulled away from the side wall 104 to open the opening 114, the user may then grab one or more portable pack containers 10 which are presented at the opening 114 from the container 100. Preferably, the user grabs the bottom-most portable pack container 10 of the stack of portable pack containers and dispenses the portable pack containers 10 from the bottom until all of the portable pack containers have been dispensed.

The container 100 may be freestanding to be placed in any desired location. Alternatively, the container 100 may include a device so that it can be stuck or hung on a wall or cabinet. In one embodiment, the container 100 includes adhesives (not shown) on a side wall, such as side wall 106, which would adhere the container 100 to a wall or cabinet.

Of course, it should be understood that a wide range of changes and modifications can be made to the embodiments described above. It is therefore intended that the foregoing description illustrates rather than limits this invention, and that it is the following claims, including all equivalents, which define this invention.

What is claimed is:

1. A portable, flexible facial tissue dispensing system for dispensing tissues comprising:

a generally flat flexible container, including a top wall and a bottom wall, said top wall defining an opening formed therein through which tissues are dispensed, and a stack of individually multiple folded tissues contained within said container, each of said tissues having a first dimension and a second dimension, said second dimension being generally perpendicular to said first dimension, wherein each individual tissue is multiply folded by being first reversibly folded onto itself three times to decrease the size of said tissue in said first dimension and second reversibly folded onto itself at least one time to decrease the size of said tissue in said second dimension, wherein the uppermost tissue of said stack is provided at said tissue dispensing opening, and wherein said uppermost tissue unfolds from its multiple folded position as said tissue is grasped and pulled through said tissue dispensing opening.

2. The portable, flexible facial tissue dispensing system for dispensing tissues of claim 1 wherein said tissues are about 72 square inches to about 144 square inches in area.

3. The portable, flexible facial tissue dispensing system for dispensing tissues of claim 1 wherein said tissues are about 100 square inches to about 144 square inches in area.

4. The portable, flexible facial tissue dispensing system for dispensing tissues of claim 1 wherein said container contains no less than 3 individual tissues and no more than 20 individual tissues.

5. The portable, flexible facial tissue dispensing system for dispensing tissues of claim 1 wherein said container contains no less than 5 individual tissues and no more than 10 individual tissues.

6. The portable, flexible facial tissue dispensing system for dispensing tissues of claim 1 wherein said flexible container is comprised of a plastic film material.

7. The portable, flexible facial tissue dispensing system for dispensing tissues of claim 1 wherein said flexible container is comprised of a nonwoven material.

8. The portable, flexible facial tissue dispensing system for dispensing tissues of claim 1 wherein said tissue dispensing opening is a slit.

9. The portable, flexible facial tissue dispensing system for dispensing tissues of claim 1 wherein said tissue dispensing opening is a window.

10. The portable, flexible facial tissue dispensing system for dispensing tissues of claim 9 wherein said window is rectangular, oval or circular in shape.

11. The portable, flexible facial tissue dispensing system for dispensing tissues of claim 1 further comprising a resealable closure flap covering said tissue dispensing opening, wherein said closure flap is opened for dispensing tissues through said tissue dispensing opening and said closure flap is releasably sealed to said top wall for closing said container when said container is not in use.

12. The portable, flexible facial tissue dispensing system for dispensing tissues of claim 1 wherein each tissue has a first lateral edge, a second lateral edge opposite said first lateral edge, a first longitudinal edge and a second longitudinal edge opposite said first longitudinal edge, wherein each tissue has at least three lateral fold lines parallel to said first and second lateral edges and at least one longitudinal fold line parallel to said first and second longitudinal edges, and wherein each tissue is first reversibly folded onto itself about said three lateral fold lines to decrease the size of said tissue in said first dimension and second reversibly folded onto itself about said at least one longitudinal fold line to decrease the size of said tissue in said second dimension.

13. The portable, flexible facial tissue dispensing system for dispensing tissues of claim 12 wherein said at least three lateral fold lines vary in placement between said first and second lateral edges.

14. The portable, flexible facial tissue dispensing system for dispensing tissues of claim 1 wherein each tissue is generally folded in half in said second dimension.

15. The portable, flexible facial tissue dispensing system for dispensing tissues of claim 1 wherein each tissue is reversibly folded onto itself two times in said second dimension.

16. The portable, flexible facial tissue dispensing system for dispensing tissues of claim 15 wherein said tissue is generally folded in thirds in said second dimension.

17. A portable, flexible facial tissue dispensing system for dispensing tissues comprising:

a generally flat flexible container, including a top wall and a bottom wall, said top wall defining an opening formed therein through which tissues are dispensed, and a stack of individually multiple folded tissues contained within said container, wherein each of said tissues has a first lateral edge, a second lateral edge opposite said first lateral edge, a first longitudinal edge and a second longitudinal edge opposite said first longitudinal edge, wherein each of said tissues has three lateral fold lines parallel to said first and second lateral edges and at least one longitudinal fold line parallel to said first and second longitudinal edges, wherein each of said tissues is first reversibly folded onto itself about said lateral fold lines and second reversibly folded onto itself about said at least one longitudinal fold line, and wherein one of said lateral edges of the uppermost tissue of said stack is provided at said tissue dispensing opening, and wherein said uppermost tissue unfolds from its multiple folded position as said lateral edge of said tissue is grasped and pulled through said tissue dispensing opening.

18. A method of operating a portable, flexible facial tissue dispensing system comprising:

providing a generally flat flexible container, including a top wall and a bottom wall, said top wall including an opening formed therein through which tissues are dispensed, placing a stack of individually multiply folded tissues within said container, each tissue having a first dimension and a second dimension which is generally perpendicular to said first dimension, wherein an individual tissue is first reversibly folded onto itself three times to decrease the size of said tissue in said first dimension and second reversibly folded onto itself at least one time to decrease the size of said tissue in said second dimension before being placed into said container, wherein the uppermost tissue of said stack is provided at said tissue dispensing opening, and pulling the uppermost tissue through said tissue dispensing opening such that said tissue unfolds as said tissue is grasped and pulled through said opening.

19. The method of operating a portable, flexible facial tissue dispensing system of claim 18 wherein said tissues are about 72 square inches to about 144 square inches in area.

20. The method of operating a portable, flexible facial tissue dispensing system of claim 18 wherein said container contains no less than the 3 individual tissues and no more than 20 individual tissues.

21. The method of operating a portable, flexible facial tissue dispensing system of claim 18 wherein said flexible container is comprised of a plastic film material.

22. The method of operating a portable, flexible facial tissue dispensing system of claim 18 further comprising:

providing a resealable closure flap covering said tissue dispensing opening, wherein said closure flap is opened to dispense tissues through said tissue dispensing opening, and said closure flap is releasably sealed to said top wall for closing said container when said container is not in use.

23. A container for containing and dispensing portable, flexible facial tissue dispensing systems comprising:

a generally rectangular container, including a top wall, a bottom wall, side walls and end walls, at least one of said walls including an opening formed therein, said opening generally being defined by a flap, said flap having perforated edges, and a stack of portable, flexible facial tissue dispensing systems contained within said container, wherein said perforated edges are broken to open said flap to dispense said portable, flexible facial tissue dispensing systems through said opening.

24. The container for containing and dispensing portable, flexible facial tissue dispensing systems of claim 23 wherein said opening is located on one of said side walls.

25. A method of operating a container for containing and dispensing portable, flexible facial tissue dispensing systems comprising:

providing a generally rectangular container, including a top wall, a bottom wall, side walls and end walls, at least one of said walls including an opening formed therein, said opening generally being defined by a flap, said flap having perforated edges, providing a stack of portable, flexible facial tissue dispensing systems contained within said container, breaking said perforated edges to open said flap, and removing a portable, flexible facial tissue dispensing system from said container through said opening to dispense said portable, flexible facial tissue dispensing systems.

* * * * *